United States Patent [19]

Merson

[11] 3,959,942

[45] June 1, 1976

[54] COMBINED SPACER AND TRANSVERSE REINFORCING BEAM

[75] Inventor: Karol J. W. Merson, Mississauga, Canada

[73] Assignee: Wonder Steel Manufacturing International (Ontario) Limited, Mississauga, Canada

[22] Filed: July 2, 1975

[21] Appl. No.: 592,407

[52] U.S. Cl. ..... 52/551; 52/537; 52/582; 52/630

[51] Int. Cl.[2] ..... E04D 1/30; E04C 2/32

[58] Field of Search ..... 52/537, 551, 552, 553, 52/90, 94, 582, 618, 625, 630

[56] References Cited

UNITED STATES PATENTS

| | | | |
|---|---|---|---|
| 3,511,004 | 5/1970 | Snellings | 52/582 X |
| 3,657,849 | 4/1972 | Garton | 52/537 |
| 3,820,295 | 6/1974 | Folley | 52/630 |

FOREIGN PATENTS OR APPLICATIONS

| | | | |
|---|---|---|---|
| 571,472 | 1/1958 | Italy | 52/537 |

*Primary Examiner*—J. Karl Bell

*Attorney, Agent, or Firm*—Fetherstonhaugh & Co.

[57] ABSTRACT

A sheet metal structure having two panels of substantially the same cross section connected to one another by a lap joint at their outer ends. Each panel has at least one major U-shaped section which has a base wall and a pair of oppositely disposed side walls. The base wall is formed with a plurality of minor U-shaped longitudinally extending ribs which form a plurality of alternately disposed minor crests and velleys. The major U-shaped sections and the minor ribs of the panels nest with one another at the lap joint. A spacer panel is provided for spacing the nesting ends from one another to facilitate the rigid securing of the ends. The spacer panel has a body portion formed with a plurality of spacer lugs at one edge thereof which project outwardly from the body portion in a spaced relationship. The lugs have a thickness substantially equal to the thickness of the panels which are to be joined. The lugs are located between the overlapping base walls of the panels and space the base wall panels apart to permit nesting of the ends of the panels at the lap joint without requiring deformation of either of the nesting panels.

12 Claims, 3 Drawing Figures

COMBINED SPACER AND TRANSVERSE REINFORCING BEAM

This invention relates to sheet metal lap joints. In particular this invention relates to a lap joint between the ends of panels formed with a plurality of longitudinally extending ridges and a spacer for use therein.

PRIOR ACT

In the formation of a lap joint connecting the ends of sheet metal panels used in the construction of buildings and the like it is important to ensure that the securing pins are not subjected to any undue bending forces. The securing pins or set screws are best able to resist shear forces and the strength of the assembly is improved by ensuring that the panels which are bolted together are secured with respect to one another without any gaps therebetween in the area of the securing bolts. In order to achieve intimate contact between the overlapping sections of the lap joint in a sheet metal panel assembly wherein the panel is formed with a plurality of generally U-shaped corrugations, it has been proposed to swage in the ends of one of the sections so that it will fit in a close fitting relationship within the ends of the other section. This requires an additional forming operation and it is costly and time-consuming. The swaging practice provides two different types of panels which are not interchangeable or it requires panels which have two ends of a different configuration.

The difficulties of the prior art described above cannot be satisfactorily overcome by simply placing a spacer between the corrugations at each point which is to be bolted together to form the lap joint as the installation of the spacers would be extremely time-consuming and costly.

SUMMARY

The present invention overcomes the difficulties of the prior art and provides a simple and inexpensive spacer construction, which, in addition to the spacing of the panels at the lap joint to eliminate the requirement for swaging, also serves as a transverse reinforcing member.

According to an embodiment of the present invention there is provided a sheet metal structure comprising at least two panels of substantially the same cross section connected to one another by a lap joint at the overlapping ends, a spacer panel which has a body portion which has a spacer edge extending transversely across the major U-shaped section of the panel and a plurality of spacer lugs at the spacer edge projecting outwardly from the body portion in a spaced relationship, the lugs being located between overlapping base walls of the U-shaped panels and spacing the base walls apart to permit nesting of the ends of the panels at the lap joint without requiring deformation of either panel.

According to a further embodiment of the present invention, the spacer panel described above is connected at its oppositely disposed ends to the side walls of the U-shaped section and serves as a transverse reinforcing element.

PREFERRED EMBODIMENT

Figure 2:
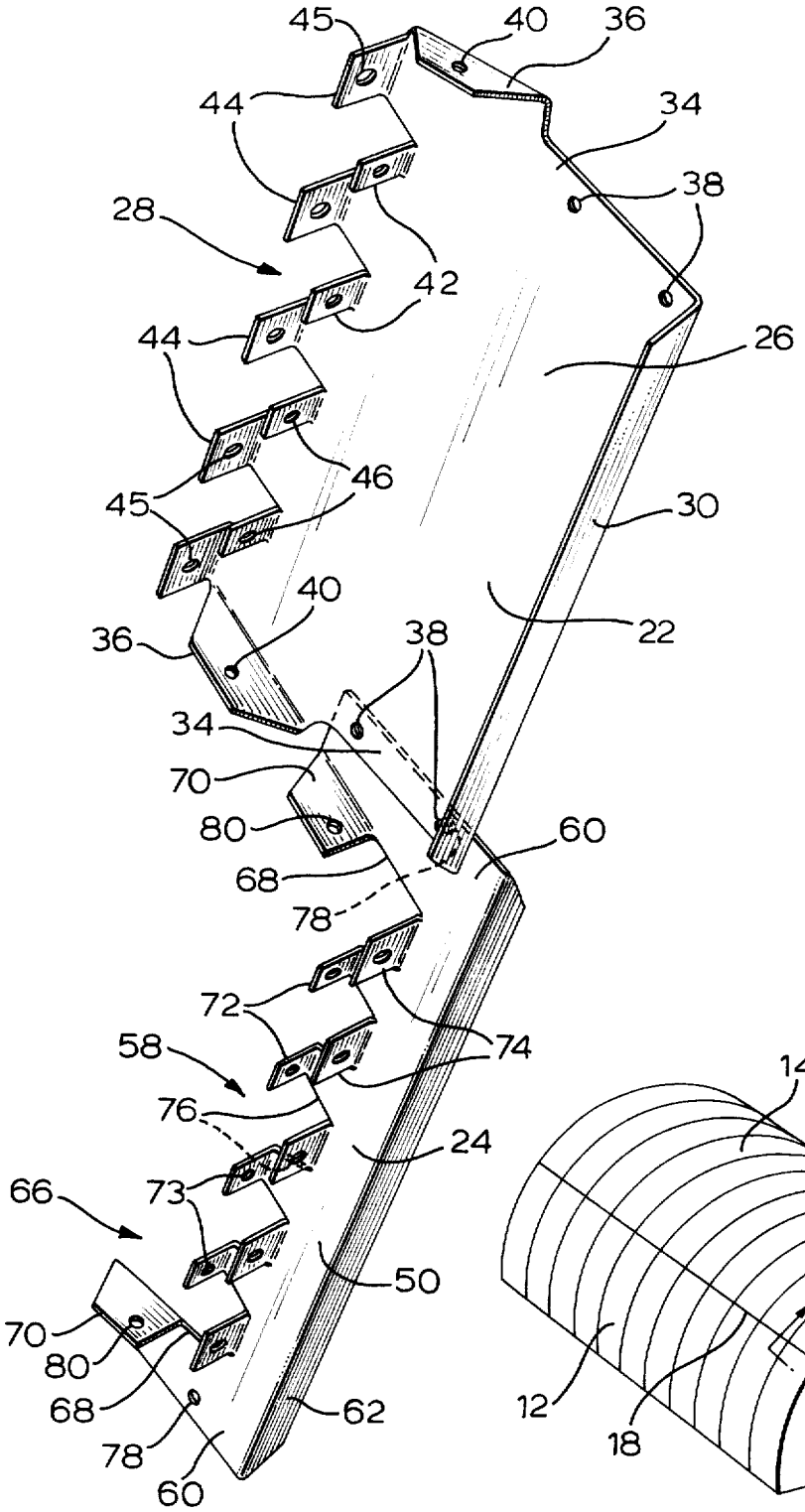
Figure 1:
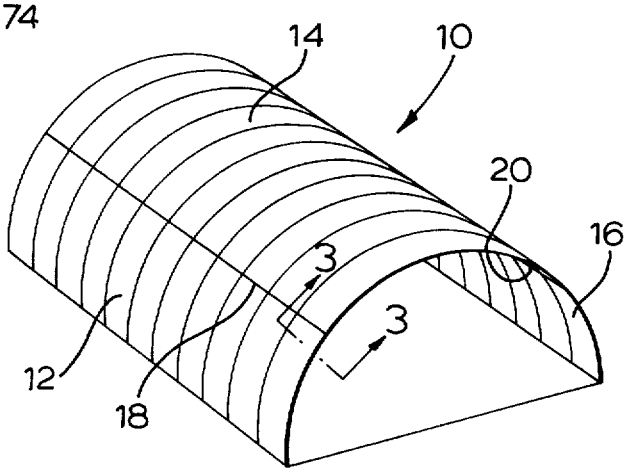
Figure 3:
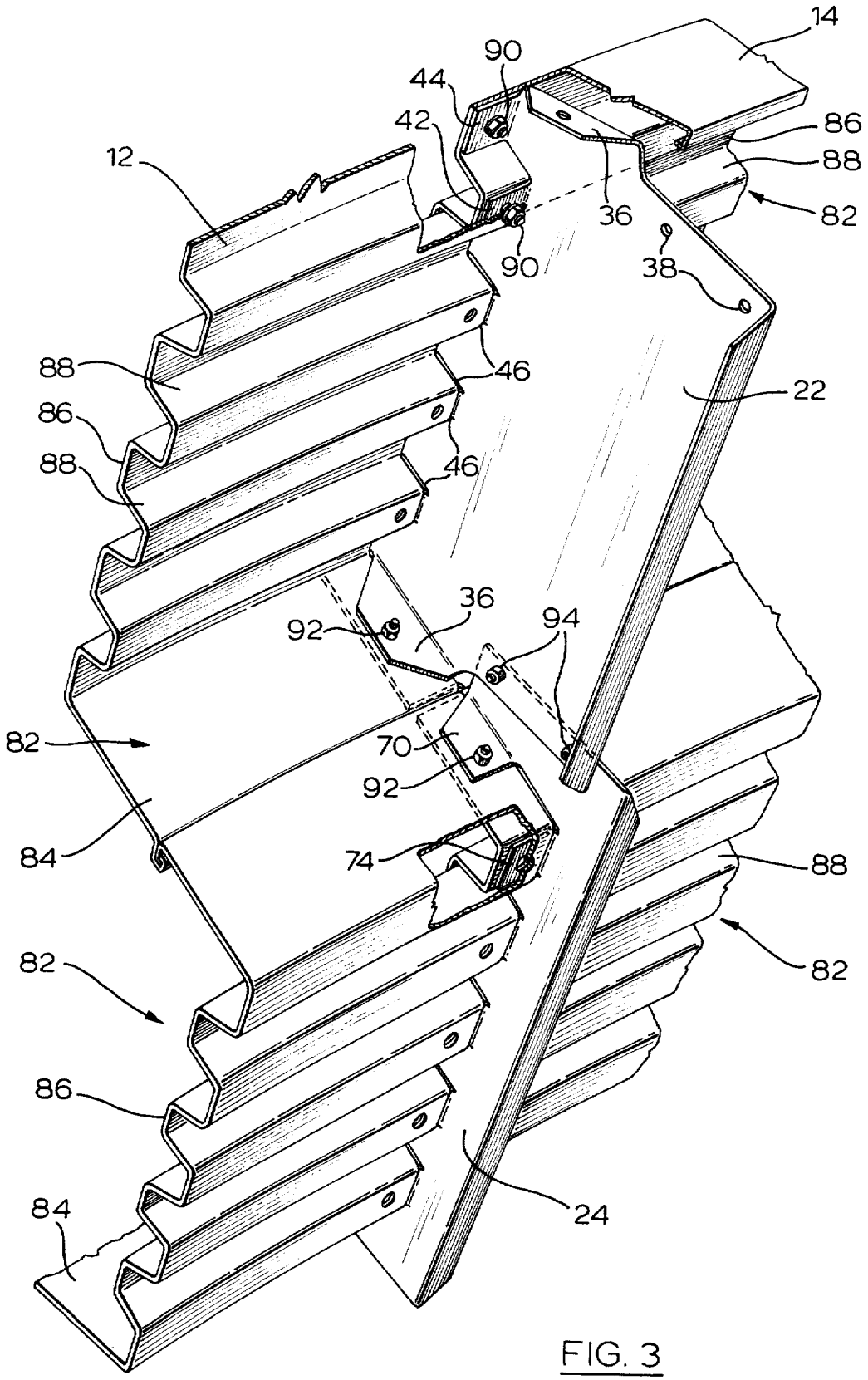

The invention will be more clearly understood after reference to the following specification read in conjunction with the drawings, wherein FIG. 1 is a diagrammatic illustration of a sheet metal building in which the sheet metal structure of the present invention may be employed;

FIG. 2 is a pictorial view of a pair of spacer plates according to an embodiment of the present invention; and FIG. 3 is a partially sectioned pictoral view of a lap joint taken on the line 3—3 of FIG. 1.

With reference to the drawings, the reference numeral 10 refers generally to a fabricated steel building in which panels 12, 14 and 16 are connected along lap joints 18 and 20.

FIG. 2 of the drawings pictorially illustrates a pair of spacer plates 22 and 24. The spacer plate 22 has a body portion 26 which has a spacer edge generally identified by the reference numeral 28 extending along one side thereof and a transverse reinforcement flange 30 extending along the opposite side thereof. The body 26 also has a pair of oppositely disposed end edges 34 which have flanges 36 extending outwardly therefrom. Passages 38 formed at the end edges 34 and passages 40 are formed in the flanges 36. The spacer edge 28 of the body is cut and folded on itself to provide an inner row of spacer lugs 42 and an outer row of spacer lugs 44. Each of the outer lugs 44 extends from the end of a lip portion 45 which has a pair of inwardly diverging side edges 46.

The second spacer panel 24 has a body portion 50, spacer edge 58, a pair of oppositely disposed end edges 60 and a reinforcing flange 62 extending between end edges 60. The spacer edge 60 in the second spacer member is located in a U-shaped recess 66 in the body 62. The U-shaped recess has oppositely disposed side edges 68, each of which has a flange 70 projecting outwardly therefrom. Spacer lugs 72 and 74 are formed in the two spaced parallel rows and the lugs 72 are located at the upper ends of lip portions with generally diverging side edges 76. Passages 78 are formed in the body 24 at each end edge 60 and passages 80 are formed in flanges 70.

With reference to FIG. 3 of the drawings, it will be seen that panels 12 and 14 each consists of a series of major U-shaped sections 82 in which each adjacent U-shaped section is oppositely disposed. Each major U-shaped section 82 has oppositely disposed side walls 84 and a base wall 86. The base walls 86 are formed with a plurality of minor U-shaped longitudinally extending ribs 88, which form a plurality of alternately disposed minor crests and valleys. The ends of the panels 12 and 14 are overlapped, as shown in FIG. 3 of the drawings, and the lugs 42, 44, 74 and 76 are located between the overlapping ends of panels 12 and 14. The spacer lugs 42, 44, 74, 76 serve to space the bottom walls 88 of the overlapping panels away from one another a distance sufficient to permit nesting between the panels without spaces being provided between the transversely extending portions of the bottom wall, thereby permitting locking pins 90 to extend between the overlapping ends and through the passages 45 and 73 in the spacer plates without any gap being provided therebetween.

The end flanges 36 and 70 of the panels 22 and 24 are secured to the oppositely disposed side walls of the major U-shaped panels by set screws 92. The body portions 22 and 24 of the spacer panels are secured to one another by set screws 94 which extend through passages 38 and 78.

The transverse rigidity of the bottom walls 86 is increased by the fact that the side edges 46 and 76, which support the outer spacer lugs 44 and 72 respectively, bear against the side walls of the minor U shaped channels. The transverse rigidity is also increased by the fact that the flanges 36 and 70 of spacers 22 and 24 respectively are secured with respect to the side walls of the major U-shaped sections. The transverse rigidity is further increased by reason of the fact that the bodies 22 and 24 are secured to one another so as to form a substantially continuous transverse beam-like member.

The lugs 42, 44, 72 and 74 are preferably of a thickness equal to the thickness of the sheet metal from which the panels are formed so that the overlapping ends of adjacent panels are spaced from one another a distance which is the minimum required in order to achieve the required spacing.

Various modifications of the present invention will be apparent to those skilled in the art without departing from the scope of the invention.

From the foregoing it will be apparent that the present invention provides a simple and inexpensive form of lap joint for connecting together overlapping sheet metal structures of the type which are corrugated. The spacer member also serves to provide a transversely extending reinforcing beam member.

The embodiments of the invention in which an exclusive property or privilege is claimed are defined as follows:

1. A sheet metal structure comprising:

a. at least two panels of substantially the same cross section connected to one another by a lap joint at their outer ends, b. each panel having at least one major U-shaped section which has a base wall and a pair of oppositely disposed side walls, said base wall being formed with a plurality of minor U-shaped longitudinally extending ribs, said ribs forming a plurality of alternately disposed minor crests and valleys, c. the major U-shaped sections and the minor ribs of said panels nesting with one another at said lap joint.

d. a spacer panel having a body portion, said body portion having a spacer edge extending transversely across said major U-shaped section.

e. a plurality of spacer lugs at said spacer edge projecting outwardly from said body in a spaced relationship, said lugs having a thickness substantially equal to the thickness of said panels, f. said lugs being located between overlapping base walls of said panels and spacing said base walls apart to permit nesting of the ends of said panels at the lap joint without requiring deformation of either nesting panel.

2. A sheet metal structure as claimed in claim 1 wherein said spacer lugs are arranged in two rows disposed in a spaced parallel plane, one row of lugs being located between the crests of the overlapping minor ribs and the other row of spacer lugs being located between the valleys of the overlapping minor ribs.

3. A sheet metal structure as claimed in claim 1 including flange means at each end of said body of said spacer panel secured to said side walls of said major U-shaped panels.

4. A sheet metal structure as claimed in claim 1 wherein said spacer panels have a second transversely extending edge, said second transversely extending edge having flange means projecting outwardly therefrom at an angle to said body to increase the transverse rigidity of said body.

5. A sheet metal structure comprising:

a. at least two panels of substantially the same cross section connected to one another by a lap joint at their overlapping ends, b. each panel having at least two major U-shaped sections, each of which has a base wall and a pair of oppositely disposed side walls, the U-shaped configuration of adjacent sections of each panel being oppositely disposed to form a plurality of alternately disposed major crests and valleys, each of said base walls being formed with a plurality of minor U-shaped longitudinally extending ribs, said ribs forming a plurality of alternately disposed minor crests and valleys, c. said major U-shaped sections and said minor ribs of said panels nesting with one another at said lap joint, d. first spacer means having a body portion underlying a major crest of said panels at said lap joint, said body having a first spacer edge extending transversely across a major U-shaped section, e. a second spacer having a body portion underlying a major valley of said panels at said lap joint, said body portion having a second spacer edge extending transversely across a major U-shaped section, f. a first set of spacer lugs at said first spacer edge projecting outwardly from said body in a spaced relationship, said lugs having a thickness substantially equal to the thickness of said panels, g. said first set of lugs being located between overlapping base walls of said major U-shaped sections of a major crest, h. a second set of spacer lugs at said second spacer edge projecting outwardly from said body in a spaced relationship, said second set of lugs having a thickness substantially equal to that of said panels, i. said second set of lugs being located between overlapping base walls of said major U-shaped sections of a major valley.

6. A sheet metal structure as claimed in claim 5 wherein said first and second sets of spacer lugs each include two rows of spacer lugs disposed in spaced parallel planes, one row being adapted to be located between overlapping minor crests of said base walls and the other row being located between overlapping minor valleys of said base walls.

7. A sheet metal structure as claimed in claim 5 including flange means at each end of said first and second spacers secured to adjacent side walls of said major U-shaped panels.

8. A sheet metal structure as claimed in claim 5 wherein said first and second spacer panels each have an additional transversely extending side edge having flange means projecting outwardly therefrom at an angle to the body portion thereof to increase the transverse rigidity of said body.

9. A sheet metal structure as claimed in claim 5 wherein said first and second spacers are connected to one another to form a substantially rigid transversely extending reinforcement.

10. A sheet metal structure as claimed in claim 2 wherein each of the lugs of said one row of lugs is located at the end of a tongue portion which is adapted to fit in a close fitting relationship within the rib into which it projects.

11. A sheet metal structure as claimed in claim 5 wherein each of the lugs of said one row of lugs is located at the end of a tongue portion which is adapted to fit in a close fitting relationship within the rib into which it projects.

12. In a sheet metal structure having at least two panels of substantially the same cross section connected to one another by a lap joint at their outer ends, each panel having at least one major U-shaped section which has a base wall and a pair of oppositely disposed side walls, said base wall being formed with a plurality of minor U-shaped longitudinally extending ribs, said ribs forming a plurality of alternately disposed minor crests and valleys, the major U-shaped sections and the minor ribs of said panels nesting with one another at said lap joint, the improvement comprising:

a. a spacer panel having abody portion, said body portion having a spacer edge extending transversely across said major U-shaped section, b. a plurality of spacer lugs at said spacer edge projecting outwardly from said body in a spaced relationship, said lugs having a thickness substantially equal to the thickness of said panels, c. said lugs being located between overlapping base walls of said panels and spacing said base walls apart to permit nesting of the ends of said panels at the lap joint without requiring deformation of either nesting panel.

* * * * *